US006253722B1

(12) United States Patent
Robinson et al.

(10) Patent No.: US 6,253,722 B1
(45) Date of Patent: Jul. 3, 2001

(54) STARTING APPARATUS FOR INTERNAL COMBUSTION ENGINES

(75) Inventors: Brian W. Robinson, Dickson, TN (US); William J. McMaster, Berkeley Heights, NJ (US); Walter H. W. Marsh, Scotch Plains, NJ (US); Mark Minnichelli, Califon, NJ (US); Frank P. Aadahl, Bound Brook, NJ (US); John T. Fleming, Hackettstown, NJ (US); Roy Oppedisano, Pequannock, NJ (US); Earl Manning, Pocahontas, AR (US)

(73) Assignee: AlliedSignal Inc., Morris Township, NJ (US)

( * ) Notice: Subject to any disclaimer, the term of this patent is extended or adjusted under 35 U.S.C. 154(b) by 0 days.

(21) Appl. No.: 09/430,764

(22) Filed: Oct. 29, 1999

Related U.S. Application Data

(60) Provisional application No. 60/107,355, filed on Nov. 6, 1998.

(51) Int. Cl.[7] ..... F02N 3/00; F02N 11/12

(52) U.S. Cl. ..... 123/179.24; 123/185.2; 123/185.5; 74/139

(58) Field of Search ..... 123/179.24, 185.2, 123/185.3, 185.4, 185.5, 185.6; 74/6, 139, 140

(56) References Cited

U.S. PATENT DOCUMENTS

| | | | | |
|---|---|---|---|---|
| 3,174,471 | * | 3/1965 | Weglage et al. | 123/185.5 |
| 4,157,083 | * | 6/1979 | Smith et al. | 123/179.24 |
| 4,230,085 | * | 10/1980 | Baltz | 123/185.2 |
| 4,582,030 | | 4/1986 | Reese | 123/185 B |
| 4,615,311 | | 10/1986 | Scheckel | 123/179 P |
| 4,637,360 | | 1/1987 | Osakabe | 123/185 A |
| 4,658,775 | | 4/1987 | Greenwood et al. | 123/185 B |
| 4,662,158 | | 5/1987 | Zerrer | 56/12.7 |
| 4,732,121 | | 3/1988 | Miyata et al. | 123/185 BA |
| 4,841,929 | | 6/1989 | Tuggle et al. | 123/198 E |
| 4,850,233 | | 7/1989 | Ishigo | 74/6 |
| 4,909,201 | | 3/1990 | Nagashima et al. | 123/185 BA |
| 4,928,643 | | 5/1990 | Kampichler et al. | 123/185 B |
| 4,940,028 | | 7/1990 | Tuggle | 123/185 B |
| 4,970,998 | | 11/1990 | Tyler | 123/185 B |
| 5,014,657 | | 5/1991 | Tsunakawa et al. | 123/185 B |
| 5,065,710 | | 11/1991 | Henriksson | 123/185 B |
| 5,067,451 | | 11/1991 | Tyler | 123/185 BA |
| 5,163,393 | | 11/1992 | Naslund | 123/185.3 |
| 5,267,540 | | 12/1993 | Zerrer et al. | 123/185.3 |
| 5,287,832 | | 2/1994 | Uhl | 123/185.3 |
| 5,329,896 | | 7/1994 | Everts | 123/185.3 |
| 5,333,580 | | 8/1994 | Hopkins | 123/185.3 |
| 5,361,738 | | 11/1994 | Iida | 123/182.1 |
| 5,379,734 | | 1/1995 | Tsunoda et al. | 123/182.1 |
| 5,431,135 | | 7/1995 | Tyler | 123/185.3 |
| 5,483,931 | | 1/1996 | Stoll et al. | 123/185.3 |
| 5,513,607 | | 5/1996 | Doragrip et al. | 123/185.3 |
| 5,544,630 | | 8/1996 | Koga | 123/185.3 |
| 5,676,103 | | 10/1997 | Tsunoda et al. | 123/185.3 |
| 5,715,783 | | 2/1998 | Osakabe et al. | 123/185.3 |
| 5,765,438 | | 6/1998 | Chang | 74/6 |

OTHER PUBLICATIONS

Statutory Invention Registration No. H517 Sato et al. 9/98.

* cited by examiner

*Primary Examiner*—Andrew M. Dolinar
(74) *Attorney, Agent, or Firm*—Roger H. Criss

(57) ABSTRACT

A starting device has a rotary drive member that is operable by hand or power devices. The device has a detented or geared strip arranged to engage with a similarly detented or geared starting wheel. The teeth of these parts are designed to grab and lock with each other in the starting direction and to slip past each other in the opposite direction. Crimping, sticking and other failure modes of conventional wind up rope units are virtually eliminated. A more consistent pull is afforded owing to a constant radius interface with the starter wheel rather than a diminishing radius of the type delivered by a wound rope.

7 Claims, 6 Drawing Sheets

STARTING APPARATUS FOR INTERNAL COMBUSTION ENGINES

CROSS-REFERENCE TO RELATED APPLICATIONS

This application claims the benefit of U.S. provisional patent application Ser. No. 60/107,355, filed Nov. 6, 1998.

BACKGROUND OF THE INVENTION

1. Field of the Invention

This invention relates to starting apparatus for internal combustion engines; and more particularly to a starter strip operable to initiate movement of the starter wheel of a small engine.

2. Description of the Prior Art

Present methods and means for starting internal combustion engines, especially small engines used in lawn and power applications, and those designed for model planes and the like, need improvement. The recoil starters and the rope and pulley mechanisms presently used by these devices create a litany of problems. Examples of these problems include missed starts, poor engagements, broken cords and teeth, tangled rope, inconsistent pulls, and kick back.

One of the most troubling problems with such mechanisms is their propensity to break. Starting mechanisms have a high manufacturer return rate and are expensive to repair. Just considering the savings possible from reducing the return rate establishes a need for improvement of such starter mechanisms. Moreover, the present systems are complicated and expensive to manufacture. They require extensive, labor intensive operations and testing as well as added expense in materials for parts of the mechanisms involved. Ropes, pulleys, springs, starter dogs, knotting, handles, and gearing are all expenses that can be reduced if there were a direct starting mechanism.

For small engines the winding, flipping, or other requirements for an electric starting device all point to a need for something simpler, safer, and less expensive. Present starting systems are bulky. They contain design limitations that impede engine cooling or block the flow of cooling air to the engine. As a result, the construction materials utilized by these systems require higher melt temperatures and are heavy and expensive. These limitations tend to reduce engine efficiency and operating life by creating an operating environment wherein the engine encounters higher heat or reduced heat transfer.

Accordingly, there remains a need in the art for an improved starting apparatus for internal combustion engines.

SUMMARY OF THE INVENTION

The present invention provides a starting apparatus wherein the starting device has a rotary drive member that is operable by hand or power devices. A detented or geared strip is shaped to mesh and catch with a similarly detented or geared starting wheel. The teeth of these parts are designed to grab and lock with each other in the starting direction and to slip past each other in the opposite direction. By utilizing the detented or geared strip, oftentimes called a "zip strip", the problems heretofore encountered with recoil starters having rope and pull mechanisms are virtually eliminated.

Specifically, the present invention provides a starting apparatus for internal combustion engines comprising an elongated starter strip having a plurality of teeth along its length. A rotatable starter wheel has an edge for securely receiving the teeth of the starter strip. The teeth and the edge are adapted to grab and lock with each other when the strip is pulled in the starting direction, and slip past each other during movement of the strip in the opposite direction. An axle couples rotation of the starter wheel to the internal combustion engine; and a channel having entry and exit ends receives the starter strip and engages the teeth with the edge of the starter wheel. The strip is inserted into the entry end of the channel and pulled from the exit end, whereupon the teeth engage the edge causing the wheel to rotate. The axle is, in turn, caused to rotate, and starting of the internal combustion engine is initiated. Preferably, the starter strip is comprised of injection molded high performance plastic, such as Capron nylon 6.

Optionally, the starting apparatus further comprising a return mechanism connected to the starter strip. Pulling the starter strip from its start position through the channel causes mechanical energy to be stored in the return mechanism. When the starter strip is released, the return mechanism operates to return the starter strip to its start position.

In a further embodiment, the starting apparatus additionally comprises a gear engaged to the starter wheel; and a remote starter motor (i.e. a cordless drill) adapted for selective engagement with the gear. When the starter motor is connected to the gear its actuation causes the starter wheel to rotate. This movement, in turn, causing the internal combustion engine to start.

This invention advantageously provides a new way to pull start or power start an internal combustion engine. Crimping, sticking and other failure modes of conventional wind up rope units are virtually eliminated. Also eliminated are abrasion failures created by the presence of dirt and debris within the pulley mechanism. The starter strip of this invention delivers a more consistent pull because it provides a constant radius interface with the starter wheel rather than a diminishing radius as the rope is extended or used up in the pulley.

The starting apparatus of the present invention affords a substantial reduction in required parts. Advantageously, the recoil starter pulley cord handle and its attachment points are eliminated. Other parts such as throw-out dogs, springs, and the like, required for connection to the starting unit are also eliminated. No longer needed are expensive throw-outs and other delicate or complicated components of conventional devices, which are expensive, take time to construct and are susceptible to breaking down.

BRIEF DESCRIPTION OF THE DRAWINGS

The invention will be more fully understood and further advantages will become apparent when reference is made to the following detailed description of the preferred embodiments and the accompanying drawings in which:

FIGS. 5*a*–5*b* are detailed views in which FIG. 5*a* depicts a side section of the starter strip pushed away from the starter wheel by a disengage plate, and FIG. 5*b* depicts the disengage plate;

DESCRIPTION OF THE PREFERRED EMBODIMENTS

The starting apparatus of the present invention provides a new way to pull start or power start an internal combustion engine, which eliminates the crimping, sticking and other failure modes of wind-up rope units.

Figure 1:
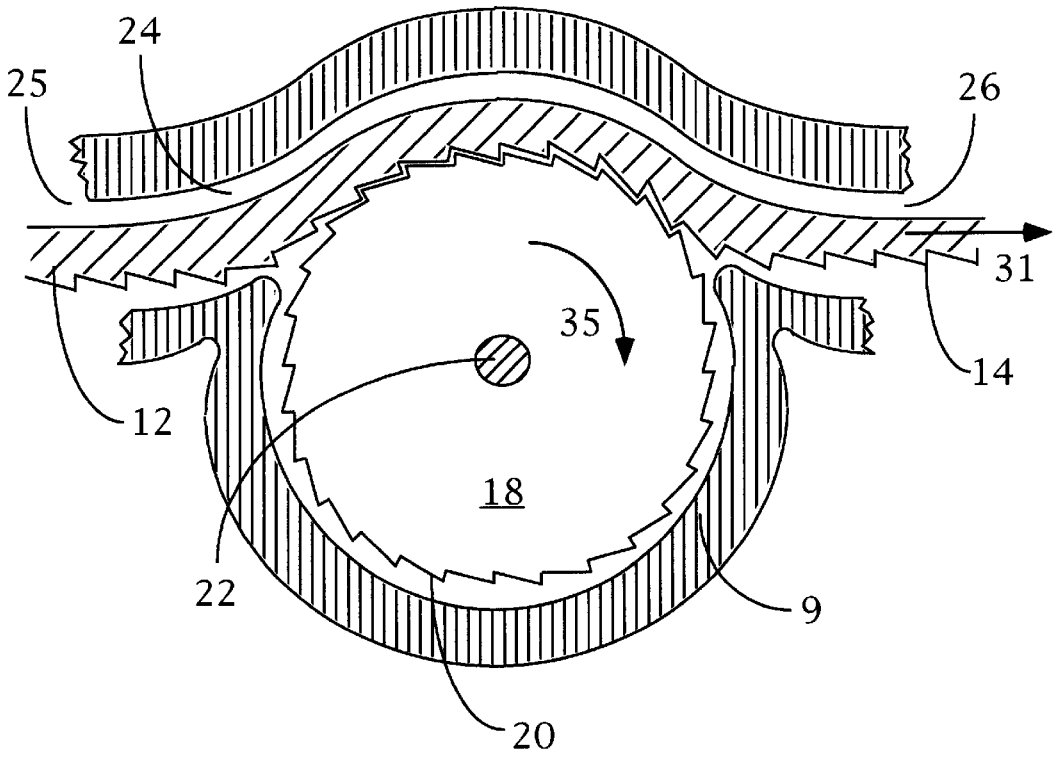
FIG. 1 is a side sectional view of a small engine incorporating the starting apparatus of this invention, including a starter strip and a starter wheel.

Referring to FIG. 1 of the drawings, there is shown the starting apparatus of the present invention disposed in housing 9 of an internal combustion engine. The starter apparatus comprises an elongated starter strip 12 provided with teeth 14 and handle 16 along its length; a rotatable starter wheel 18 having an edge 20 for securely receiving the teeth of the starter strip; an axle 22 for coupling rotation of starter wheel 18 to the internal combustion engine; and channel 24 having entry end 25 and exit end 26 for receiving starter strip 12 and for engaging teeth 14 with edge 20 of starter wheel 18. When strip 12 is inserted into entry end 25 of channel 24 and pulled from exit end 26, teeth 14 engage edge 20 causing starter wheel 18 to rotate. (It should be noted that strip 12 can alternatively be pushed in from exit end 26, or can be pushed in sideways if channel 24 is redesigned.) Axle 22 is thereby caused to rotate and, in turn, the internal combustion engine is actuated to a starting condition. Preferably, starter strip 12 is comprised of injection molded, high performance plastic, such as a nylon, preferably Capron® nylon 6 from AlliedSignal Inc.

Figure 2A:
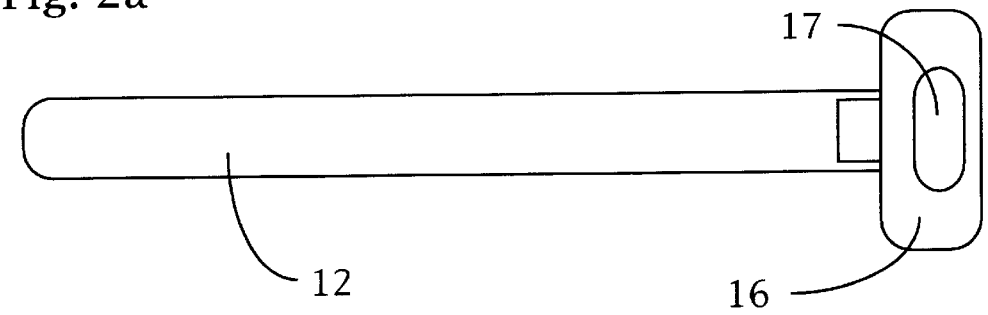
FIGS. 2*a*–2*c* are detailed views depicting, respectively, top, bottom and side views of the starter strip.
Figure 2B:
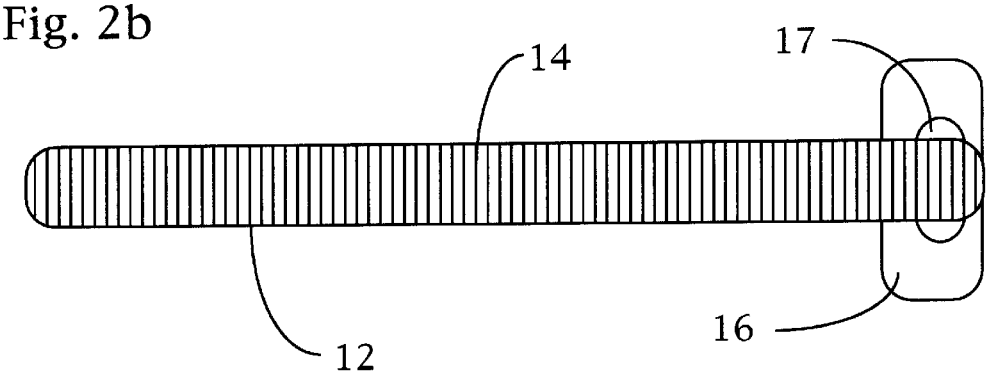
Figure 2C:
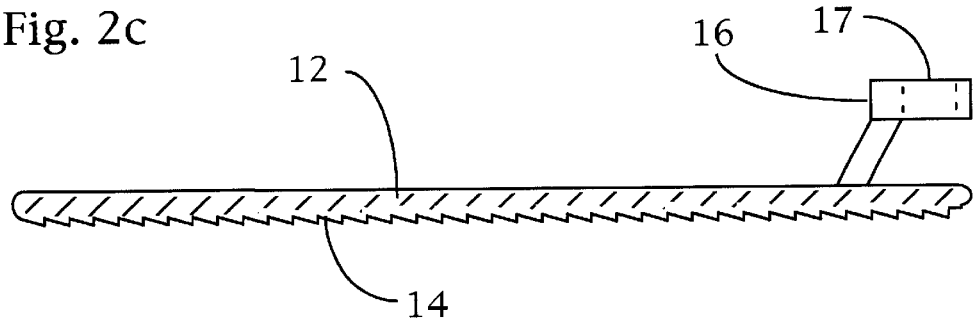

Referring to FIG. 2, the starter strip 12 is depicted. Part I of FIG. 2 is a top view in which there is shown handle 16 having opening 17 for easy grasp by the user. Part II of FIG. 2 is a bottom view of the starter strip 12 illustrating teeth 14. Part III is a side view of the starter strip 12.

Figure 3A:
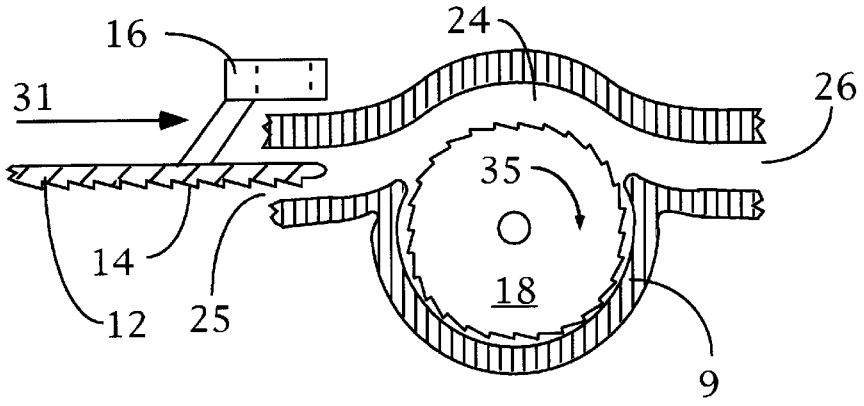
FIGS. 3*a*–3*b* are detailed views depicting, respectively, side cross sections of the return mechanism and the starter strip prior to and during engagement with the starter wheel.
Figure 3B:
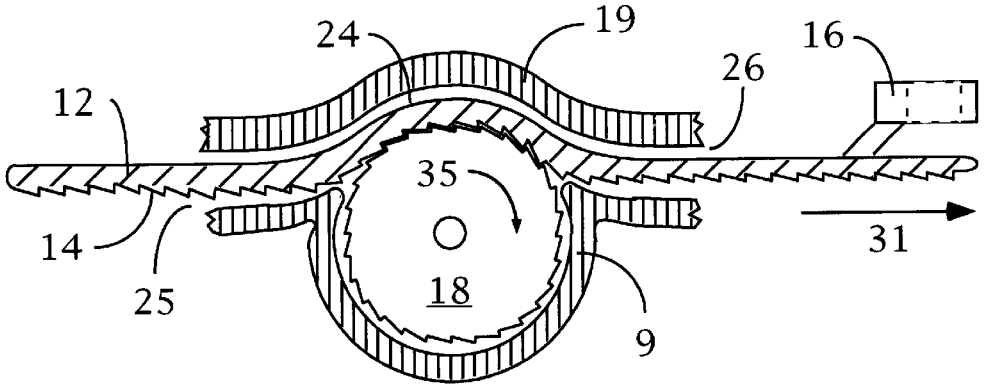

FIG. 3 shows the starter mechanism of this invention in conditions prior to and during engagement with starter strip 12. Part I shows starter strip 12 as it is pulled into entry end 25 of channel 24 prior to the engaged condition. Arrow 31 indicates the direction of starter strip 12. The handle 16 remains external from the housing 9. Part II shows the apparatus while starter strip 12 is engaged with starter wheel 18. Movement of starter strip 12 in the direction of the arrow 31 during the engaged condition causes wheel 18 to rotate in the clockwise direction, as indicated by arrow 35.

Figure 4:
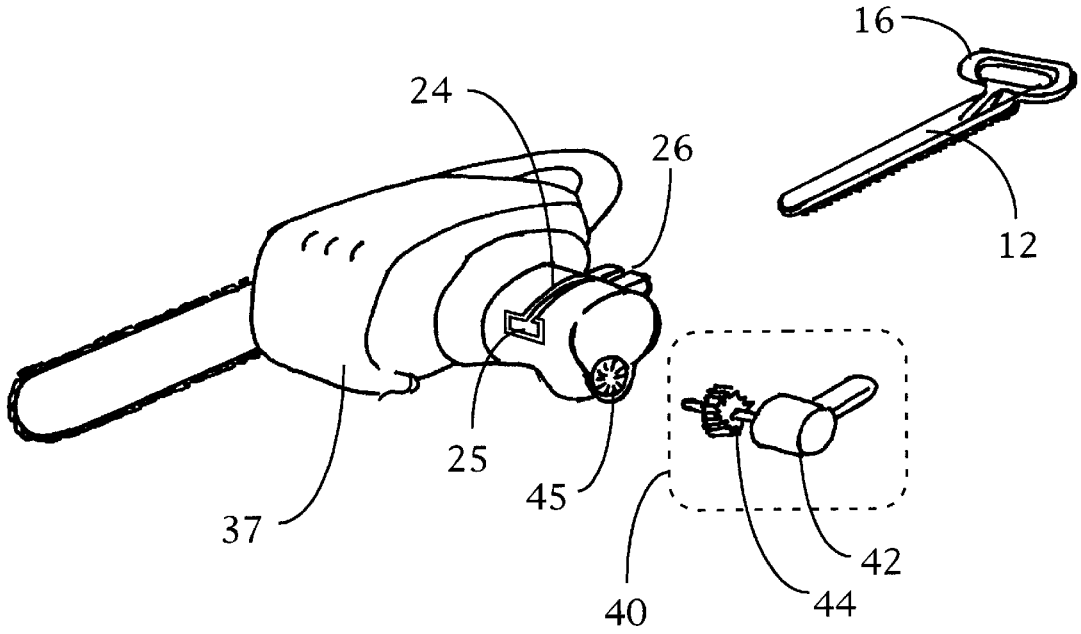
FIG. 4 is a perspective view illustrating the starting apparatus of the invention, including a starter strip and channel, adapted for use with a chain saw.

FIG. 4 illustrates the starter apparatus of the present invention in a chain saw device 37. In operation, starter strip 12 is grasped by handle 16, inserted into entry end 25, pulled through channel 24, and out exit end 26. Optionally, the starter strip is stored in a pocket on the housing of the chain saw 37.

Also shown in FIG. 4 is an optional battery pack starter 40. In this embodiment, starter 40 is part of a cordless drill, and can be used to start the engine by engagement with the internal starter wheel through a diaphragm opening in the housing 45. Battery pack starter 40 includes a gear 44 engaged to the internal starter wheel; and a remote starter motor 42. The starter motor 42 is connected to gear 44, which engages the edge of the starter wheel causing the starter wheel to rotate. This rotation of the starter wheel, in turn, causes the internal combustion engine to start.

Figure 5A:
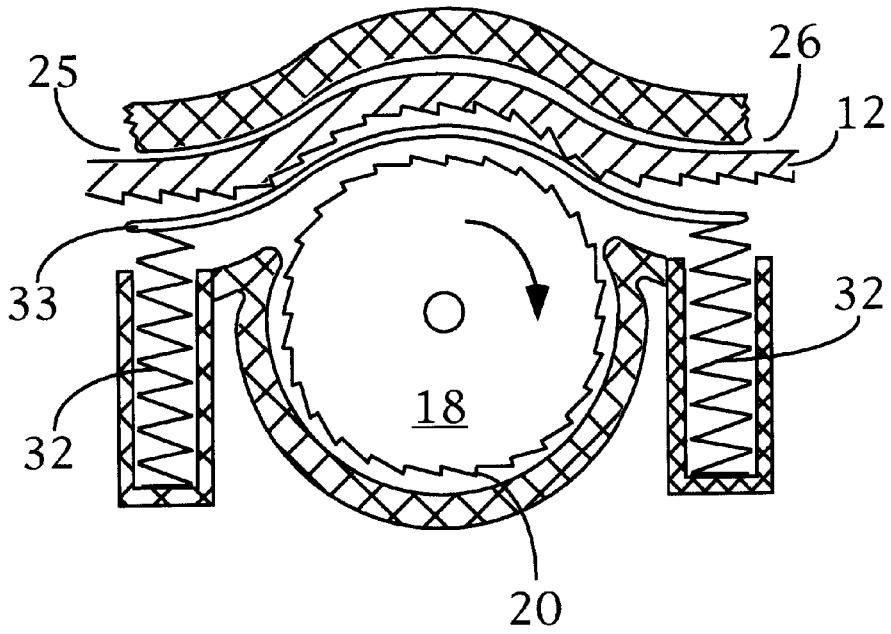
Figure 5B:
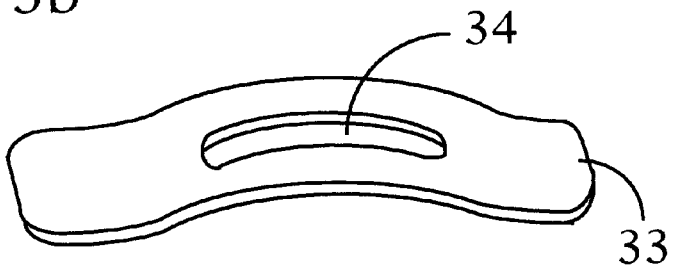

Referring to FIG. 5 of the drawings, there is shown an embodiment of the starting apparatus having a kick-out means. Specifically, the kick-out means comprises springs 32 disposed on each side of starter wheel 18 and disengage plate 33. The springs 32 bias the plate 33 upward causing starter strip 12 to move away from edge 20 of starter wheel 18. Plate 33, can alternatively, be constructed so the upward bias is produced by the arcuate shape thereof without need of springs 32. Part I of FIG. 5 shows starter strip 12 pushed away from starter wheel 18 by disengage plate 33 when starter strip 12 is in a released condition. Part II of FIG. 5 shows a perspective view of disengage plate 33. Actuation of the kick-out means causes the starter strip to be pushed away from the starter wheel by the disengage plate. When pulling on the starter strip to start the engine, the tension overcomes the spring bias and the starter strip meshes with the edge of the starter wheel. Opening 34 allows starter strip 12 to engage starter wheel 18 when starting.

Figure 6:
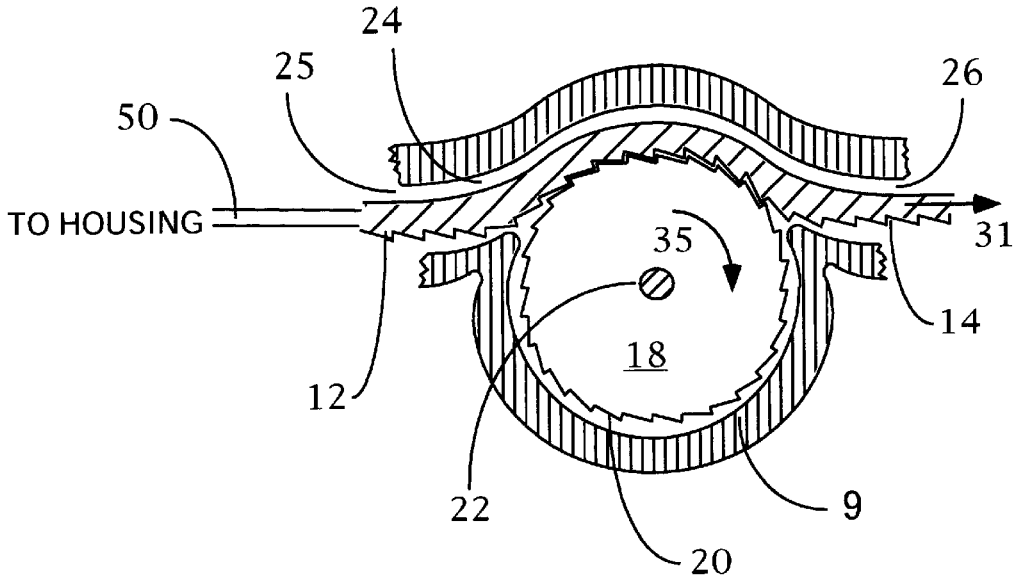
FIG. 6 is a side sectional view of a small engine showing a stretchable return cord in relation to the starter wheel.

A stretchable return cord 50 (FIG. 6) or a spring return device may optionally be employed to return the starter strip to its initial position. Mechanical energy is stored in the stretchable return cord 50 or spring return device on starting the engine. This mechanical energy is used to return the starter strip to its start position. Return of the starter strip is accomplished by attaching an elastic return strip between the housing 9 and the starter strip 50. Mechanical energy stored by the stretchable return cord 50 operates to return the starter strip to its starting position.

The system of this invention is adapted to be incorporated on power units in essentially the same way that pulleys are presently incorporated. Power units equipped with the starting apparatus of the invention do not generally require the throw-outs or other connect/disconnect devices. As such, they are less expensive to build and much more easily assembled. Design and construction of the starting apparatus of our invention can be further simplified by incorporating the detents or gearing into the flywheel. With that embodiment, throw-outs are not required. Moreover, a much simpler and more reliable spring system can be utilized to disengage the starter strip if an automatic winding system is incorporated.

Rotation of the starter wheel is shown in the figures as being clockwise. However, it will be understood by those skilled in the art that such rotation could alternatively be designed to be counterclockwise (depending on engine construction) by threading the strip underneath, instead of on top of, the starter wheel. The edge of the starter wheel may be provided with sloped teeth for better grip. With this construction, the force required for pushing of the starter strip is reduced and starting of the engine is facilitated. When the starter strip is pulled, the rotation of the starter wheel forces the flexible starter strip away from the starter wheel, since the starter strip is flexible. In this flexed condition, the teeth of the starter strip are no longer engaged with the edge of the starter wheel but are instead pushed out of the way. This construction of the starter strip assists in repositioning of the starter strip in the event re-pulling of the strip is required.

Having described the invention in rather full detail, it will be understood that such detail need not be strictly adhered to but that various changes and modifications may suggest themselves to one skilled in the art, all falling within the scope of the invention as defined by the subjoined claims.

We claim:

1. A starting apparatus for an internal combustion engine, comprising:

a. an elongated starter strip provided with teeth along its length;

b. a rotatable starter wheel having an edge for securely receiving said teeth of said starter strip, said teeth and said edge being constructed to grab and lock with each other during pulling of said strip in the starting direction, and to slip past each other during movement of said strip in a direction opposite to said starting direction;

c. an axle for coupling rotation of said starter wheel to said internal combustion engine; and d. a channel having entry and exit ends for receiving said starter strip and for engaging said teeth with said edge of said starter wheel;

whereby said strip is inserted into said entry end of said channel and pulled from said exit end; during pulling, said teeth engage said starter wheel edge causing said wheel to rotate; said axle is thereby caused to rotate, and actuation of said internal combustion engine is initiated.

2. A starting apparatus as recited by claim 1, wherein said starter strip comprises an injection molded high performance plastic.

3. A starting apparatus as recited by claim 1, wherein said starter strip is comprised of a nylon plastic.

4. A starting apparatus as recited by claim 1, further comprising a return mechanism connected to said starter strip, and being constructed so that pulling said starter strip from its start position through said channel causes mechanical energy to be stored in said return mechanism in such amount that, upon release of said starter strip, said return mechanism returns said starter strip to said start position.

5. A starting apparatus as recited by claim 1, further comprising:

a. a gear engaged to said starter wheel; and b. a remote starter motor, whereby, upon connection of said starter motor to said gear, said starter wheel rotates initiating actuation of said internal combustion engine.

6. A starting apparatus as recited by claim 1, wherein said starter wheel additionally serves as a flywheel for said internal combustion engine.

7. A starting apparatus as recited by claim 1, further comprising:

a. a disengage plate having an opening large enough to allow said starter strip to engage said edge; and b. at least one bias spring for biasing said disengage plate upward, so that said starter strip is pushed away from the starter wheel by said disengage plate, whereby when said starter strip is pulled to start said engine, tension overcomes said spring bias and said starter strip meshes with said edge of said starter wheel.

* * * * *